US011039969B2

(12) United States Patent
Olsson et al.

(10) Patent No.: US 11,039,969 B2
(45) Date of Patent: Jun. 22, 2021

(54) OVERHEAD LIFT UNITS, SYSTEMS, AND METHODS FOR MOUNTING AND TRANSPORTING AN OVERHEAD LIFT UNIT

(71) Applicant: Liko Research & Development AB, Luleå (SE)

(72) Inventors: Karin Olsson, Luleå (SE); Daniel Johansson, Luleå (SE); Katharina Enström, Luleå (SE)

(73) Assignee: LIKO RESEARCH & DEVELOPMENT AB, Luleå (SE)

( * ) Notice: Subject to any disclaimer, the term of this patent is extended or adjusted under 35 U.S.C. 154(b) by 441 days.

(21) Appl. No.: 16/043,835

(22) Filed: Jul. 24, 2018

(65) Prior Publication Data

US 2019/0029904 A1 Jan. 31, 2019

Related U.S. Application Data

(60) Provisional application No. 62/539,089, filed on Jul. 31, 2017.

(51) Int. Cl.

| | |
|---|---|
| ***A61G 7/10*** | (2006.01) |
| ***B66C 19/00*** | (2006.01) |
| ***B66C 9/02*** | (2006.01) |
| ***B66C 11/06*** | (2006.01) |

(52) U.S. Cl.

CPC ..... *A61G 7/1042* (2013.01); *A61G 7/1015* (2013.01); *B66C 9/02* (2013.01); *B66C 11/06* (2013.01); *B66C 19/00* (2013.01); *B66C 2700/015* (2013.01)

(58) Field of Classification Search

CPC ..... B66C 9/02; B66C 11/04; B66C 11/06; B66C 19/00; B66C 2700/015; A61G 7/1015; A61G 7/1042

USPC ..... 104/94; 105/155

See application file for complete search history.

(56) References Cited

U.S. PATENT DOCUMENTS

| | | | | |
|---|---|---|---|---|
| 2,744,472 A * | 5/1956 | Symons | E04G 3/28 105/154 |
| 3,064,585 A | 11/1962 | Ewing | |
| 3,261,477 A * | 7/1966 | Powell | B66C 11/06 212/336 |
| 4,236,456 A | 12/1980 | Schreyer et al. | |
| 4,343,240 A * | 8/1982 | Nishimura | F16B 21/12 105/54 |

(Continued)

FOREIGN PATENT DOCUMENTS

EP 2179717 A1 4/2010

*Primary Examiner* — Zachary L Kuhfuss

(74) *Attorney, Agent, or Firm* — Dinsmore & Shohl LLP

(57) ABSTRACT

An overhead lift unit includes a carriage, a first wheel assembly, a second wheel assembly, and an actuator. The first wheel assembly includes a first wheel coupled to the carriage through a first support arm. The second wheel assembly includes a second wheel coupled to the carriage through a second support arm. The actuator is coupled to the second wheel assembly and is configured to shift the second wheel assembly in a lateral direction relative to the first wheel assembly between an expanded position and a retracted position. Lift systems including the overhead lift unit and methods of transporting the overhead lift unit to and from an overhead rail are also described.

20 Claims, 7 Drawing Sheets

(56) References Cited

U.S. PATENT DOCUMENTS

| | | | | |
|---|---|---|---|---|
| 4,843,810 | A * | 7/1989 | Kabilka | B65H 54/26 57/268 |
| 5,664,502 | A * | 9/1997 | Wilhelm | B66C 9/12 105/30 |
| 6,758,325 | B2 | 7/2004 | Greeley | |
| 6,810,817 | B1 | 11/2004 | James | |
| 8,156,874 | B2 | 4/2012 | Hansen | |
| 8,783,189 | B2 * | 7/2014 | Gouault | B66C 9/06 104/95 |
| 8,978,905 | B2 | 3/2015 | Bergenstråle et al. | |
| 9,061,839 | B2 | 6/2015 | Murayama | |
| 9,663,331 | B2 * | 5/2017 | Buhlmayer | B66C 11/06 |
| 10,266,183 | B1 * | 4/2019 | Napieralski | B65G 17/20 |
| 2014/0075669 | A1 * | 3/2014 | Andersson | F16D 13/12 5/85.1 |

* cited by examiner

OVERHEAD LIFT UNITS, SYSTEMS, AND METHODS FOR MOUNTING AND TRANSPORTING AN OVERHEAD LIFT UNIT

CROSS-REFERENCE TO RELATED APPLICATION

This application claims the benefit of priority to U.S. Provisional Application Ser. No. 62/539,089, filed Jul. 31, 2017, and entitled "Overhead Lift Units, Systems, and Methods for Mounting and Transporting an Overhead Lift Unit," the entirety of which is incorporated by reference herein.

TECHNICAL FIELD

The present specification generally relates to overhead lift units and, more specifically, to overhead lift units, systems, and methods for transporting an overhead lift unit to and from an overhead rail.

BACKGROUND

Overhead lifting devices, or lift units, such as patient lifts used in the health care industry, may generally be coupled to an overhead rail system with a carriage which facilitates positioning the overhead lift unit along the length of the rail. Sometimes, it may be desirable or necessary to dismount the overhead lift unit from the overhead rail system, such as to transport the lift to a different overhead rail system not connected to the first overhead rail system or to service the overhead lift unit. Because such lift units are generally suspended well above the ground on the overhead rail system, ladders or other such structures may be required to allow an operator or service person to reach the overhead lift unit to manually remove it from the overhead rail. Manipulating the lift unit to extract the lift unit from the rail may be difficult due to the weight of the lift unit and may be further complicated by the overhead position of the lift unit.

Accordingly, a need exists for alternative overhead lift units, systems and methods for mounting and dismounting an overhead lift unit on an overhead rail system.

SUMMARY

In one embodiment, an overhead lift unit includes a carriage, a first wheel assembly, a second wheel assembly, and a guide assembly. The first wheel assembly includes a first wheel coupled to the carriage through a first support arm. The second wheel assembly includes a second wheel coupled to the carriage through a second support arm. The guide assembly includes a bearing member and a guide member along which the bearing member is slidable. The guide assembly is coupled to the second wheel assembly and is configured to shift the second wheel assembly in a lateral direction relative to the first wheel assembly between an expanded position and a retracted position.

In another embodiment, a lift system includes an overhead rail defining an opening and a carriage support channel and an overhead lift unit. The overhead lift unit includes a carriage, a first wheel assembly, a second wheel assembly, and an actuator. The first wheel assembly is configured to extend through the opening of the overhead rail and to ride along the carriage support channel and includes a first wheel coupled to the carriage through a first support arm. The second wheel assembly is configured to extend through the opening of the overhead rail and to ride along the carriage support channel and includes a second wheel coupled to the carriage through a second support arm. The actuator is coupled to the second wheel assembly and is configured to shift the second wheel assembly in a lateral direction relative to the first wheel assembly between an expanded position in which the first wheel assembly and the second wheel assembly are coupled with the overhead rail, and a retracted position in which the first wheel assembly and the second wheel assembly are configured to pass through the opening in the overhead rail.

In yet another embodiment, a method of transporting an overhead lift unit to and from an overhead rail includes: one of attaching the overhead lift unit to the overhead rail and detaching the overhead lift unit from the overhead rail. The overhead rail defines an opening and a carriage support channel. The overhead lift unit includes a first wheel assembly, a second wheel assembly, and an actuator. The first wheel assembly includes a first wheel coupled to the carriage through a first support arm. The second wheel assembly includes a second wheel coupled to the carriage through a second support arm. The actuator is coupled to the second wheel assembly. Attaching the overhead lift unit to the overhead rail includes extending the first wheel assembly and the second wheel assembly through the opening of the overhead rail, shifting the second wheel assembly from a retracted position to an expanded position with the actuator, wherein a lateral distance from an outer surface of the first wheel assembly to an outer surface of the second wheel assembly is increased; and supporting a weight of the overhead lift unit on the carriage support channel with the first wheel of the first wheel assembly and the second wheel of the second wheel assembly. Detaching the overhead lift unit from the overhead rail includes shifting the second wheel assembly from the expanded position to the retracted position, wherein the lateral distance from the outer surface of the first wheel assembly to the outer surface of the second wheel assembly is decreased, and lowering the overhead lift unit from the overhead rail through the opening.

These and additional features provided by the embodiments described herein will be more fully understood in view of the following detailed description, in conjunction with the drawings.

BRIEF DESCRIPTION OF THE DRAWINGS

The embodiments set forth in the drawings are illustrative and exemplary in nature and not intended to limit the subject matter defined by the claims. The following detailed description of the illustrative embodiments can be understood when read in conjunction with the following drawings, where like structure is indicated with like reference numerals and in which:

DETAILED DESCRIPTION

Embodiments disclosed herein include overhead lift systems and methods that allow for lift units, such as patient lift units used in hospital and/or rehabilitation settings, to be mounted and dismounted from rails of the overhead lift system. Specifically, embodiments described herein include an overhead lift unit that includes a carriage, a first wheel assembly, a second wheel assembly, and an actuator. The second wheel assembly can be actuated by the actuator to move laterally toward and away from the first wheel assembly to either reduce the distance between the first wheel assembly and the second wheel assembly (i.e., a retracted position) or increase the distance between the first wheel assembly and the second wheel assembly (i.e., an expanded position). In the retracted position, the carriage is able to slide through an opening in the overhead rail so as to be easily removed from or added to the overhead rail. This may allow operators and servicemen to more easily transport lift units to and away from overhead rails. While in the expanded position, the carriage may ride securely ride along the overhead rail. In some embodiments, the carriage may include a locking mechanism to lock the one of the second wheel assembly in the expanded position so as to prevent accidental movement of the carriage to the retracted position when the lift unit is carrying a load. Various embodiments of lift units, overhead lift systems comprising lift units, and methods of using the lift units will be described in more detail herein with specific reference to the corresponding drawings.

Figure 1:
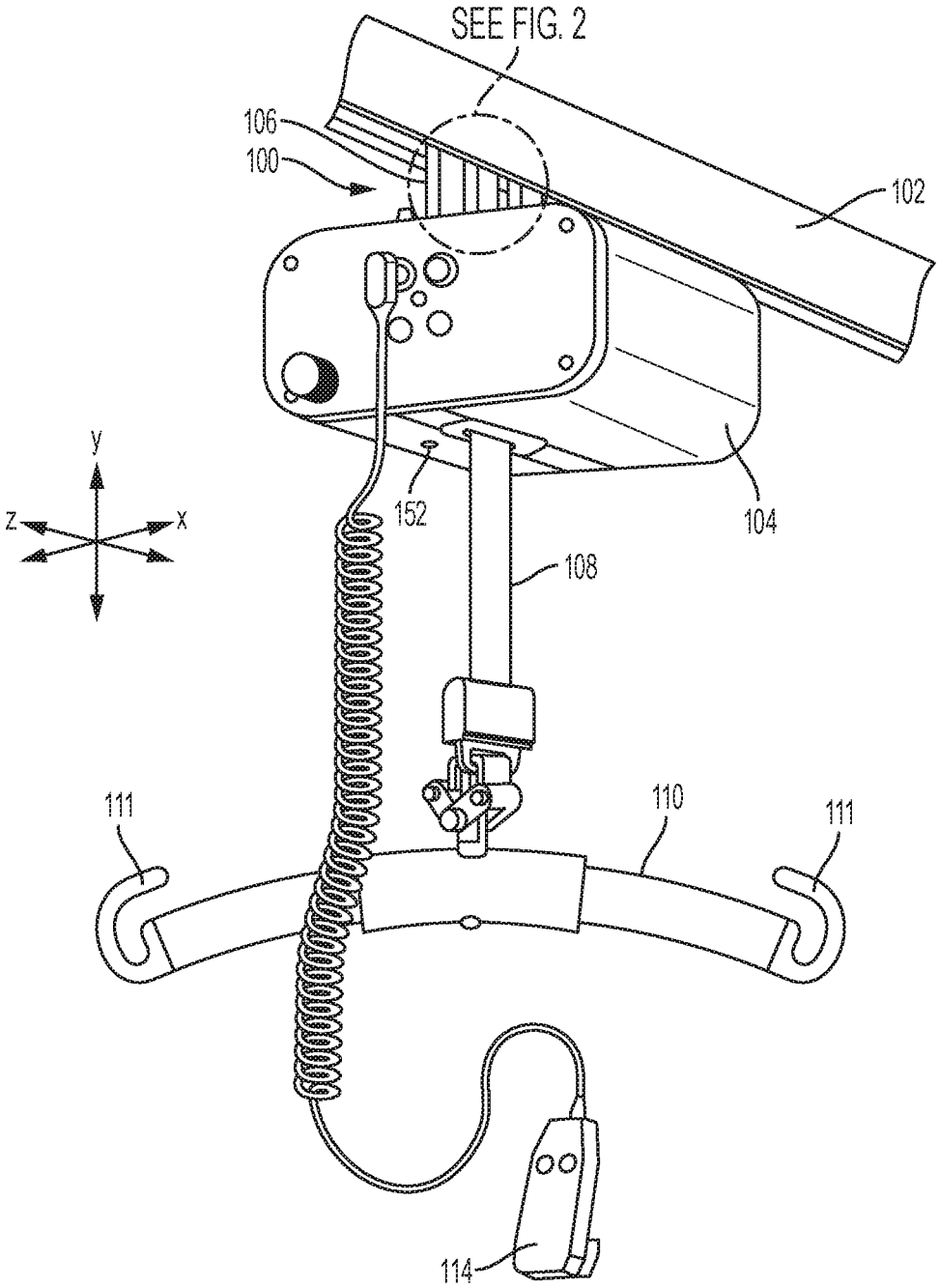
FIG. 1 schematically depicts the an overhead lift system including an overhead lift unit, according to one or more embodiments shown and described herein.

FIG. 1 schematically illustrates a perspective view of an overhead lift system 100. The overhead lift system 100 generally comprises a lift unit 104 which is slidably coupled to an overhead rail 102 with a carriage 106. The lift unit 104 may be used to support and/or lift a patient with a lifting strap 108 which is coupled to a motor (not shown) contained within the lift unit 104. The motor facilitates paying-out or taking-up the lifting strap 108 from the lift unit 104 thereby raising and lowering a patient attached to the lifting strap 108. In the embodiments described herein, the lift unit 104 further includes a battery which is housed in the lift unit 104 and electrically coupled to the motor thereby providing power to the motor. However, it should be understood that, in other embodiments, the lift unit 104 may be constructed without the battery, such as when the motor is directly coupled to a power source.

In the embodiment of the overhead lift system 100 shown in FIG. 1, a patient may be attached to the lifting strap 108 with a sling bar 110 or a similar accessory attached to the lifting strap 108. More specifically, the sling bar 110 or a similar accessory may be attached to a harness or sling in which the patient is positioned thereby facilitating the lifting operation. The lift unit 104 may be actuated with a user input device 114 which is communicatively coupled to the motor. In the embodiment shown in FIG. 1, the user input device 114 is directly wired to the lift unit 104. However, it should be understood that, in other embodiments, the user input device 114 may be wirelessly coupled to the lift unit 104 to facilitate remote actuation of the lift unit 104.

In various embodiments, the lifting strap 108 is configured to be extended and retracted by the lift unit 104. The sling bar 110 is coupled to an end of the lifting strap 108 through a connector. The lift unit 104 may further include a motor and a drum (not shown), each positioned within a housing of the lift unit 104. The drum may be coupled to a shaft of the motor and the motor may be configured to extend and retract the lifting strap 108 as the motor rotates the drum in response to a user providing an input to the control system via the user input device 114. Various lift units may be employed, including those described in U.S. Patent Application Publication No. 2015/0216753, entitled "Person Lift System," which is hereby incorporated by reference in its entirety. Suitable commercially available lift units include, by way of example and not limitation, lift systems available under the trade names GOLVO®, LIKO®, SABINA®, VIKING®, UNO™, LIKO-GUARD™, LIKORALL™, and MULTIRALL™, from Liko, HILL-ROM®, or Hill-Rom Services, Inc. (Batesville, Ind.).

In various embodiments, such as the embodiment depicted in FIG. 1, a subject support apparatus may be coupled to the lift unit 104 using the sling bar 110. As shown in FIG. 1, the sling bar 110 includes an elongated bar and two hooks 111 coupled to the distal ends of the elongated bar. In other embodiments, the sling bar 110 may be an X-shaped sling bar that includes two curved frame members coupled by a middle frame member and including four support apparatus coupling mechanisms, or hooks. In still other embodiments, the sling bar may include a U-shaped frame including two support apparatus coupling mechanisms and a U-shaped handle extending from the frame to provide stability to a subject being lifted. Other sling bar configurations are contemplated. Various sling bar configurations are described in greater detail in U.S. Patent Application Publication No. 2015/0216753, entitled "Person Lift System," which is hereby incorporated by reference in its entirety.

Suitable sling bars include, by way of example and not limitation, those commercially available under the trade names Universal SlingBar, SlingBar Mini, and Sling Cross-Bar, from Liko, HILL-ROM®, or Hill-Rom Services, Inc. (Batesville, Ind.). Additionally, it is contemplated that some embodiments may not include a sling bar.

Figure 2:
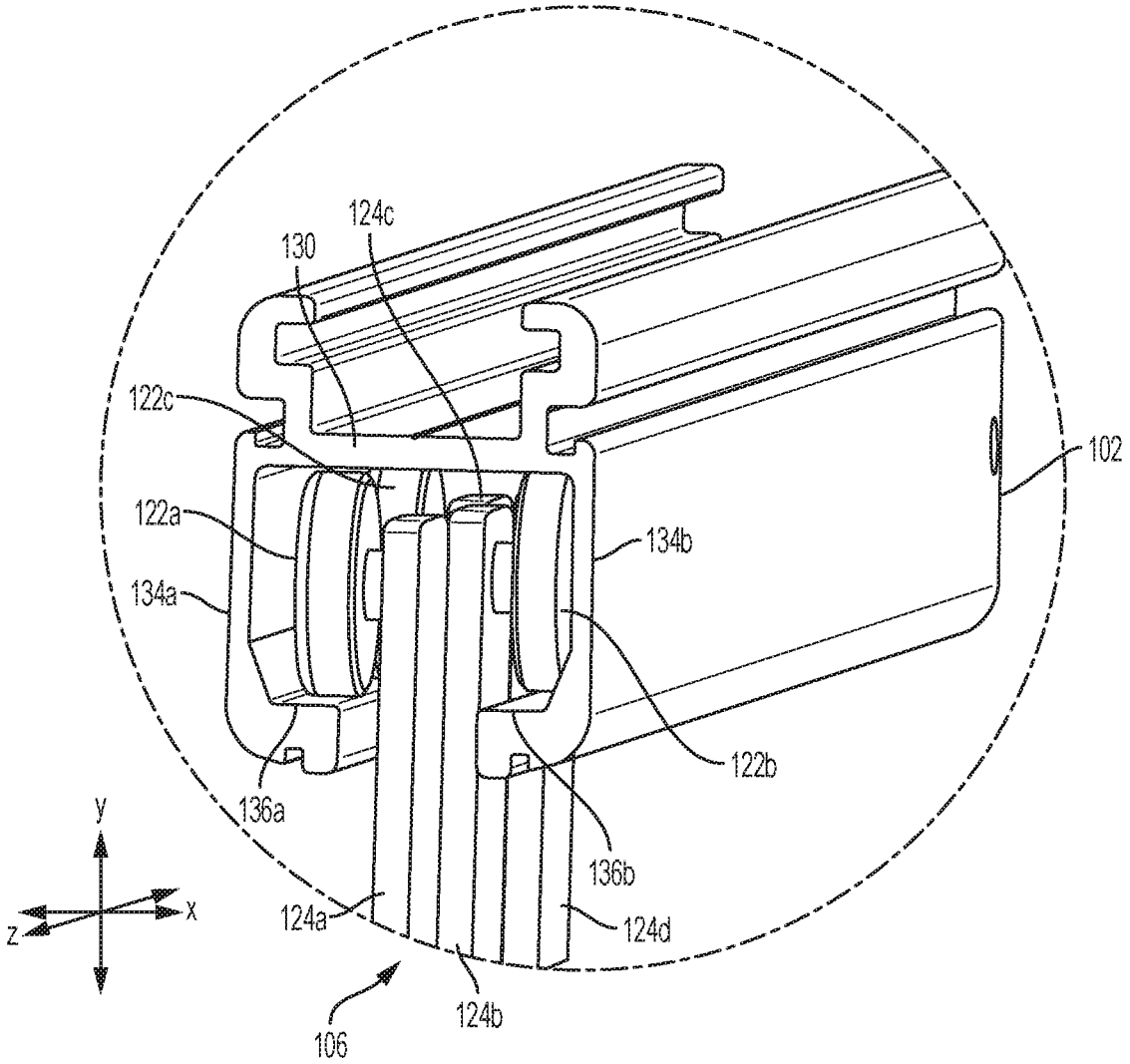
FIG. 2 schematically depicts a carriage of the overhead lift unit of FIG. 1 mounted in an overhead rail and in a locked configuration, according to one or more embodiments shown and described herein.
Figure 3:
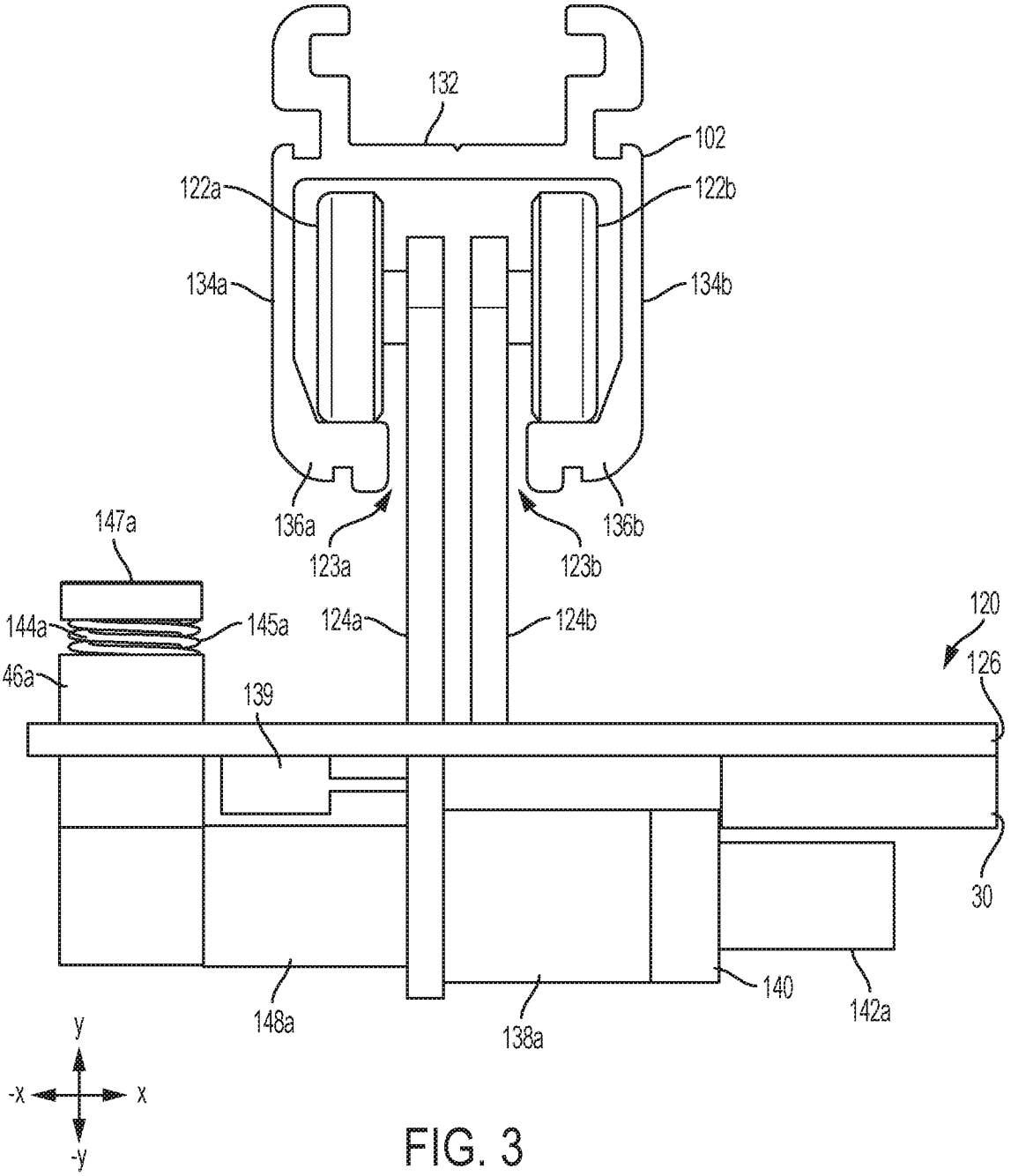
FIG. 3 schematically illustrates a front view of the carriage of FIG. 2, according to one or more embodiments shown and described herein.
Figure 4:
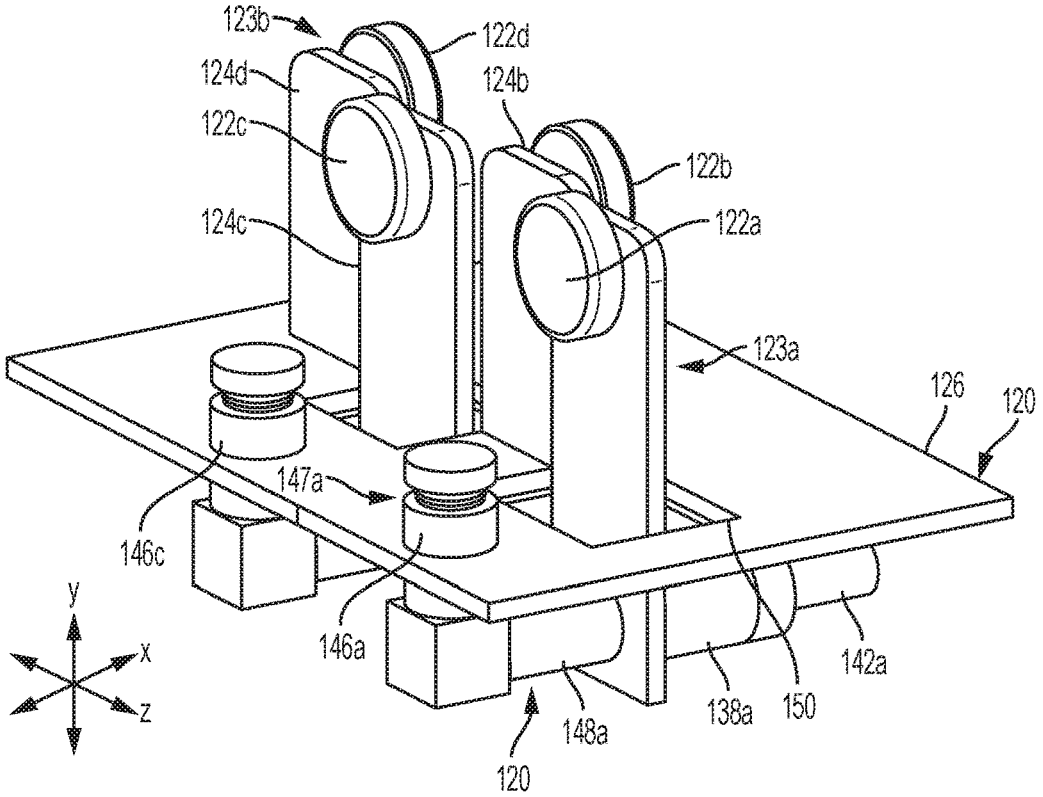
FIG. 4 schematically illustrates a perspective view of the carriage of FIG. 2 in isolation from the overhead rail, according to one or more embodiments shown and described herein.
Figure 5:
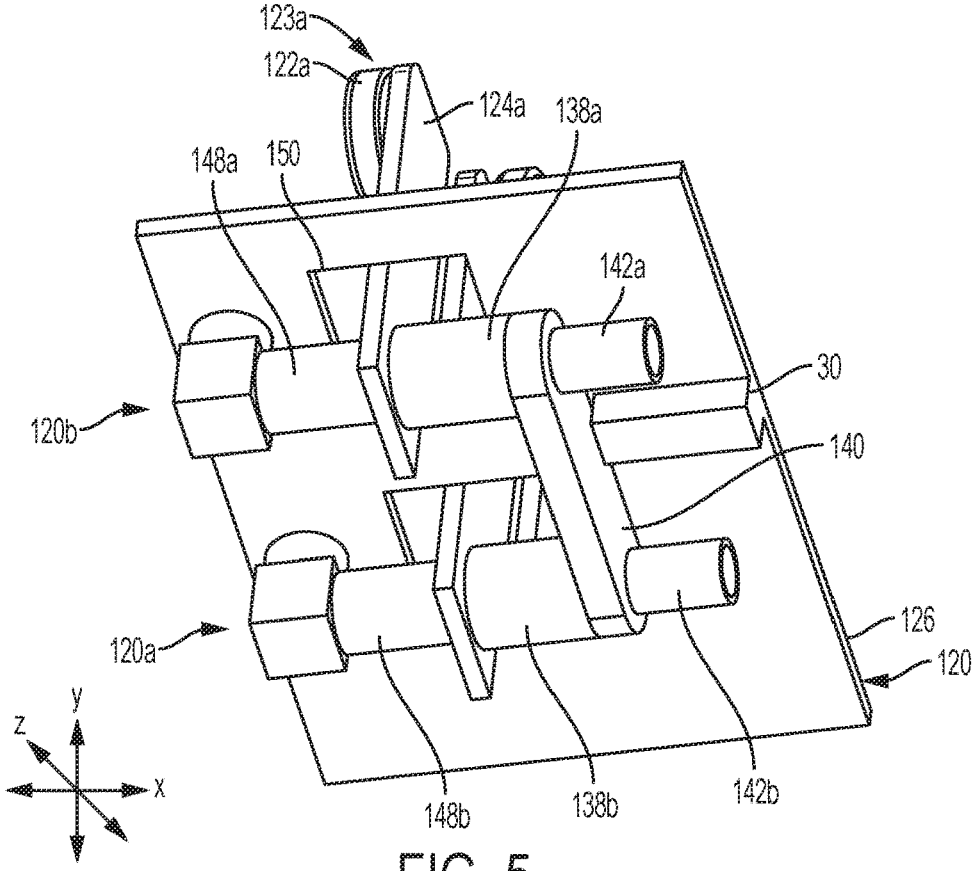
FIG. 5 schematically illustrates a perspective view of an underside of the carriage of FIG. 4, according to one or more embodiments shown and described herein.

Referring now to FIGS. 2-5, several views of the carriage 106 are provided. In the views, coordinate axes are depicted in which the Z axis is generally up and down while the X and Y axes lie in the same horizontal plane. The carriage 106 may be used to couple the lift unit 104 to the overhead rail 102. Specifically, FIG. 2 illustrates an isometric view of the carriage 106 positioned within an overhead rail 102 in an expanded position (described in further detail herein). FIG. 3 illustrates a front view of the carriage 106 positioned within the overhead rail 102 in the expanded position (described in further detail herein). FIG. 4 illustrates an isometric view of the carriage 106 in isolation from the overhead rail 102. FIG. 5 illustrates another isometric view of the carriage 106 in isolation from the overhead rail 102 to better schematically display a locking mechanism of the carriage 106.

The carriage 106 generally comprises a carriage body 120 which includes a plurality of support wheels 122*a*, 122*b*, 122*c*, and 122*d*, which are rotatably attached for supporting the carriage 106 within the overhead rail 102. The support wheels 122*a*, 122*b*, 122*c*, and 122*d* facilitate positioning the carriage 106 and the lift unit 104 along the length of the rail. In the embodiments described herein, the carriage 106 is depicted with four support wheels. However, it is contemplated that the carriage 106 may be constructed with fewer than four support wheels. For example, the carriage 106 may be constructed with two support wheels (i.e., a pair of support wheels). In some embodiments, the carriage 106 may be constructed with more than four support wheels.

The support wheels 122*a*, 122*b*, 122*c*, and 122*d* are each coupled to the carriage 106 through corresponding support arms 124*a*, 124*b*, 124*c*, and 124*d*. As used herein, a "wheel assembly" refers to at least one support wheel and corresponding support arm. Accordingly, in the embodiment depicted in FIGS. 2-5, the carriage 106 includes two wheel assemblies 123*a* and 123*b* each including two support wheels and corresponding support arms, although it is contemplated that embodiments may include three wheel assemblies, or more. In various embodiments, two or more wheel support wheels and the corresponding support arms may be coupled together to form the wheel assembly in order to enable simultaneous movement. For example, as shown in FIGS. 4 and 5, the support wheels 122*a* and 122*c* and corresponding support arms 124*a* and 124*c* on the left side of the carriage 106 may be coupled together into a wheel assembly 123*a* via a coupler 140 (shown in FIG. 5) to enable the support wheels to be shifted into an expanded position simultaneously, as will be described in detail below. In various embodiments, the wheel assemblies 123*a* and 123*b* may be staggered in a longitudinal direction with respect to the overhead rail 102 (in the Z direction and along the length of the overhead rail 102). In such embodiments, when the wheel assemblies are in a retracted position relative to one another, at least a portion of the wheel assemblies are aligned in the lateral direction with respect to the overhead rail 102 (in the X direction and along the width of the overhead rail 102).

In the embodiment of the carriage 106 depicted in FIGS. 3A and 3B, the support wheels 122*a*, 122*b*, 122*c*, and 122*d* are passive (i.e., the support wheels are not actively driven with a motor or a similar drive mechanism) and the overhead lift unit 104 is manually traversed along the overhead rail 102. However, in alternative embodiments (not shown), the support wheels 122*a*, 122*b*, 122*c*, and 122*d* may be actively driven such as when the support wheels 122*a*, 122*b*, 122*c*, and 122*d* are coupled to a motor or a similar mechanism. In such embodiments, the drive mechanism may be communicatively coupled to the user input device (such as user input device 114 shown in FIG. 1) which actuates the drive mechanism and facilitates traversing the overhead lift unit 104 along the overhead rail 102 with the drive mechanism.

As will be described in greater detail below, in various embodiments, at least one of the wheel assemblies may be actuated to shift between an expanded position (shown in FIGS. 2-6) and a retracted position (shown in FIGS. 7 and 8). For example, the first wheel assembly may be fixed relative to the carriage 106 while the second wheel assembly is coupled to an actuator that is configured to move the wheel assembly in a lateral direction relative to the first wheel assembly. For example, in FIGS. 3-5, the support arms 124*b* and 124*d* are affixed to a carriage support plate 126 while the support arms 124*a* and 124*c* pass through the carriage support plate 126 and are moveable relative to the carriage support plate 126 and the wheel assembly 123*b* affixed thereto. In various embodiments, the expanded position enables the carriage 106 remain engaged with an overhead rail 102, while the retracted position enables the carriage 106 to be inserted in or removed from the overhead rail 102, as will be described in greater detail below.

Referring to FIGS. 2, 3, and 6-8, the overhead lift system 100 further comprises an overhead rail 102 in which the carriage 106 is slidably disposed for movement relative to the overhead rail 102. Accordingly, it should be understood that, when the overhead lift unit 104 is mechanically coupled to the carriage 106, the overhead lift unit 104 may be traversed along the overhead rail 102 with the carriage 106. The overhead rail 102 may be formed from a metallic material, such as aluminum, an aluminum alloy, or a similar metallic material, and generally includes an upper portion 132, a first sidewall 134*a* integrally formed with the upper portion 132, and a second sidewall 134*b* integrally formed with the upper portion 132. The upper portion 132, the first sidewall 134*a*, and the second sidewall 134*b* are oriented such that the upper portion 132, the first sidewall 134*a*, and the second sidewall 134*b* form a carriage support channel within which the carriage 106 is slidably disposed. To that end, the first sidewall 134*a* further comprises a first support flange 136*a* which extends from the first sidewall 134*a* into the support channel and the second sidewall 134*b* further comprises a second support flange 136*b* which extends from the second sidewall 134*b* into the support channel. In various embodiments, the first support flange 136*a* and the second support flange 136*b* form the carriage support channel.

In the embodiments described herein, the first support flange 136*a* and the second support flange 136*b* are generally opposed to one another and lie in a common horizontal plane. Accordingly, when the wheel assemblies are in the expanded position, the wheel assembly including the support wheel 122*a* rides along the first support flange 136*a* and the wheel assembly including the support wheel 122*b* rides along the second support flange 136*b*. The first support flange 136*a* and the second support flange 136*b* define an opening in the overhead rail 102 through which the support arms 124*a*, 124*b* extend when the support wheels 122*a*, 122*b* are coupled with the overhead rail 102. In various embodiments, when in the retracted position, an outer surface of the wheel assembly including the support wheel 122*a* and the outer surface of the wheel assembly including the support wheel 122*b* are separated by a distance less than the width of the opening between the first support flange 136*a* and the second support flange 136*b*, thereby enabling the support wheels to pass through the opening in the retracted position. In various embodiments, the outer surface of each wheel assembly may be a surface of the support wheel separated from the support arm by the thickness of the wheel.

The first support flange 136*a* and the second support flange 136*b* may also be substantially parallel with the upper portion 132 of the overhead rail 102. However, it should be understood that other configurations of the support flanges and the upper portion of the overhead rail 102 are also contemplated. For example, in an alternative embodiment, the support flanges may be upwardly angled with respect to the horizontal plane. Moreover, it should be understood that the structure of the overhead rail 102 depicted in the figures is exemplary and that other rail configurations are contemplated.

FIG. 3 depicts a front view of a carriage 106 slidably disposed within the carriage support channel of the overhead rail 102. In particular, the wheel assembly that includes support wheel 122*a* and support arm 124*a* are shown in an expanded position relative to the wheel assembly that includes support wheel 122*b* and support arm 124*b*. It can be seen in FIG. 3 that the support arm 124*b* is affixed to the carriage support plate 126 while the support arm 124*a* passes through an aperture 150 (shown in FIGS. 4 and 5) in the carriage support plate 126 such that the support wheel 122*a* and a first portion of the support arm 124*a* are proximate a top side of the carriage support plate 126 while a second portion of the support arm 124*a* is proximate a bottom side of the carriage support plate 126.

Figure 6:
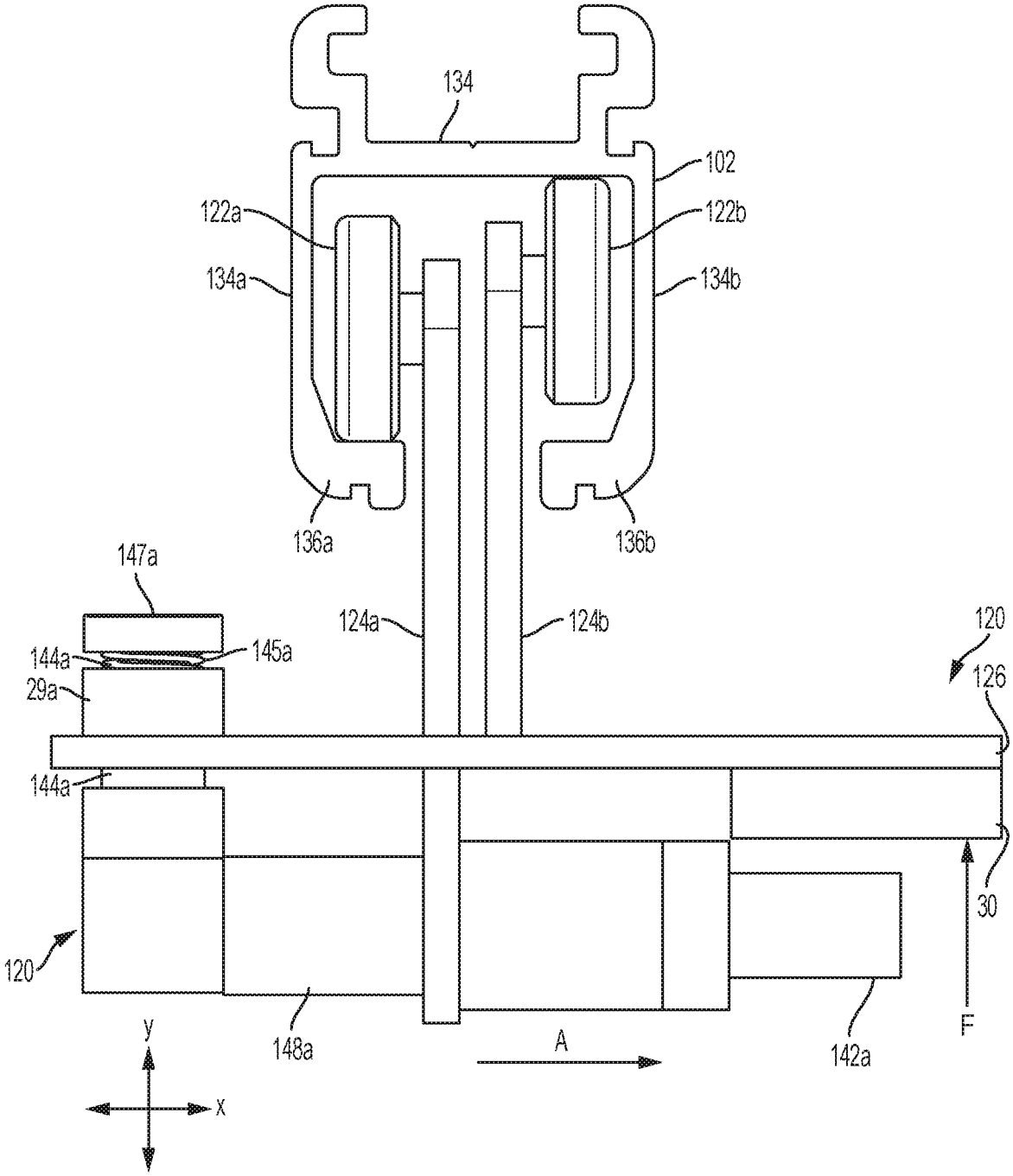
FIG. 6 schematically illustrates a front view of the carriage of FIG. 2 in an unlocked configuration, according to one or more embodiments shown and described herein.

In various embodiments, the support arm 124*a* passes through the aperture 150 in the carriage support plate 126 and is moveable laterally with respect to the support arm 124*b*, or in the +/−X direction, as indicated by the X-Y axes shown in FIG. 3 and by the arrow A in FIG. 6. To facilitate movement in the +/−X direction, the support arm 124*a* is coupled to a guide assembly that includes at least a bearing member 138*a* and a guide member 142*a*. The bearing member 138*a* is slidable in the +/−X direction along the guide member 142*a* to enable expansion and retraction of the wheel assembly relative to the other wheel assembly.

In some embodiments, an actuator 139 (shown in FIG. 3) is configured to drive the support arm 124*a* along the guide member 142*a*, although it is also contemplated that the support arm 124*a* may be shifted between the expanded and retracted positions manually. In particular, the actuator 139 may be coupled to at least one support arm of the wheel assembly 123*a* (in FIG. 3, support arm 124*a*) and to the carriage support plate 126 such that actuating the actuator 139 exerts a force on the support arm 124*a* and slides the support arm 124*a* along the guide member 142*a* via the bearing member 138*a*. In embodiments employing an actuator 139, any suitable actuator may be used, including, but not limited to, pneumatic, hydraulic, piezoelectric, or electromechanical actuators.

In embodiments employing an actuator, the actuator 139 may be actuated by a user input, such as a button 152 (shown in FIG. 1), lever, or similar input device. The button 152 may be located in any suitable position. For example, in the embodiment depicted in FIG. 1, the button 152 may be positioned on the lift unit 104 such that a user lifting the lift unit 104 into position within the overhead rail 102 can easily depress the button 152 with a thumb or finger while supporting the lift unit 104. However, it is contemplated that the button 152 may be located elsewhere, such as on a side of the lift unit 104.

In still other embodiments, a controller (not shown) is communicatively coupled to the actuator. The controller may be a microprocessor or other computing device that is operable to actuate the actuator and cause the wheel assemblies to move between the expanded and retracted positions. The controller may execute logic to cause the actuator 139 to shift the wheel assemblies between expanded and retracted positions. In various embodiments, the logic may be stored in a memory device and executed by a processor of the controller. A user input device, such as the user input device 114, may be communicatively coupled to the controller. Accordingly, when the user input device 114 receives an input, the controller may cause the actuator 139 to shift the wheel assemblies between the expanded position and the retracted position.

In embodiments in which the actuator 139 is coupled to a controller, the controller may be further operable to provide feedback to the user regarding the expansion or retraction of the wheel assemblies. For example, when the wheel assemblies have been shifted to the expanded position by the actuator 139, the controller may provide a notification to the user input device 114 indicating that the carriage 106 and the lift unit 104 are ready for use. Alternatively, when the wheel assemblies have been shifted to the retracted position by the actuator 139, the controller may provide a notification to the user input device 114 indicating that the carriage 106 is ready for removal from the overhead rail 102. It is contemplated that the controller may have additional functions and features that may be advantageous in various embodiments.

Still referring to FIGS. 3-7, a guide stop 148*a* is positioned along the guide member 142*a* to prevent the bearing member 138*a* from being shifted too far in the −X direction. Although depicted throughout the figures, it is contemplated that the guide stop 148*a* is optional. For example, in some embodiments in which the actuator is configured to stop at a predetermined position along the guide member 142*a*, the guide stop 148*a* may not be included. However, in other embodiments, such as when the bearing member 138*a* is manually slid along the guide member 142*a*, the guide stop 148*a* may be employed.

In various embodiments, the support arm 124*a* is moveable in both the +/−X direction and the +/−Y direction of the X-Y axes shown in FIG. 3. In such embodiments, the guide member 142*a* (and, therefore, the support arm 124*a*) is coupled to a vertical bearing member 144*a* which is slidable in the +/−Y direction through a vertical guide member 146*a*. In various embodiments, a spring 145*a* may be positioned around the vertical bearing member 144*a* between a vertical stop member 147*a* and the vertical guide member 146*a* and biases the vertical bearing member 144*a* in a −Y direction relative to the carriage support plate 126, as shown in FIGS. 6 and 7. Accordingly, the support arm 124*a* and the support wheel 122*a* may be moved vertically with respect to the support arm 124*b* and the support wheel 122*b*.

In various embodiments, the vertical movement of the wheel assembly 123*a* including the support arm 124*a* and the support wheel 122*a* facilitates a locking mechanism 30 locking the wheel assembly in the expanded position thereby preventing the wheel assembly from being moved to a retracted position relative to the wheel assembly including the support arm 124*b* and the support wheel 122*b* when a load is supported by the carriage 106 and/or the overhead lift system 100. In other words, the locking mechanism 30 may be actuated when the wheel assemblies are supporting at least the weight of the overhead lift unit within the overhead rail 102. In the embodiments depicted in the figures, the locking mechanism 30 is in the form of a block, which prevents the wheel assembly including the support arm 124*a* and the support wheel 122*a* from moving in the +X direction when a load is supported by the carriage 106.

In particular, the locking mechanism 30 may be affixed to an underside of the carriage support plate 126. The carriage support plate 126 may be affixed to the housing of the lift unit 104 and may, for example, be affixed within the housing or form a top part of the housing. It should be understood that the carriage support plate 126 may be affixed to the lift unit in other ways, provided that there is sufficient space for movement of the components positioned below the carriage support plate 126 as depicted in FIGS. 4 and 5, including the locking mechanism 30, the bearing member(s), the coupler 140, the guide member(s), and the guide stop(s). When the lift unit 104 is coupled to the carriage support plate 126 and the lift unit is supported by the overhead rail 102, as shown in FIG. 3, the weight of the load (i.e., the weight of the lift unit) pulls the carriage support plate 126 down relative to the support wheel 122*a*, shifting the support arm 124*a* upward through the aperture in the carriage support plate 126, and bringing the coupler 140 and/or the bearing member 138*a* at least partially into alignment with the locking mechanism 30. Once the coupler 140 and/or the bearing member 138*a* is at least partially in alignment with the locking mechanism 30, the locking mechanism 30 prevents the bearing member 138*a* from moving in the +X direction. Thus, the locking mechanism 30 prevents the support wheel 122*a* from shifting into the retracted position relative to the support wheel 122*b* when a load, such as the lift unit 104, is supported by the carriage 106.

In order to remove the lift unit 104 from the overhead rail 102, a user applies an upward force F on the carriage support plate 126, as shown in FIG. 6. The force F on the carriage support plate 126 may be, for example, a user pressing up on the lift unit 104 to which the carriage support plate 126 is affixed. As the force F is applied to the carriage support plate 126, the carriage support plate 126, the support arm 124*b*, and the support wheel 122*b* are shifted upward relative to the support wheel 122*a*, deactivating the locking mechanism by moving the locking mechanism 30 out of alignment with the bearing member 138*a* such that the bearing member 138*a* can be moved in the direction of the arrow A. The support wheel 122*a* and the support arm 124*a* may be shifted to the right along the guide member 142*a* in FIG. 6 to move the wheel assembly from the expanded position, as shown in FIG. 6, to the retracted position, as shown in FIG. 7. For example, in embodiments where the carriage comprises an actuator, after applying the force F to the carriage support plate 126, the user may press the button 152 to actuate the actuator to shift the wheel assembly along the guide member 142*a*. In embodiments where the carriage does not include an actuator, after applying the force F to the carriage support plate 126, the user may manually shift the when assembly along the guide member 142*a*, such as by applying a force in the X direction to the support arm 124*a*.

Figure 7:
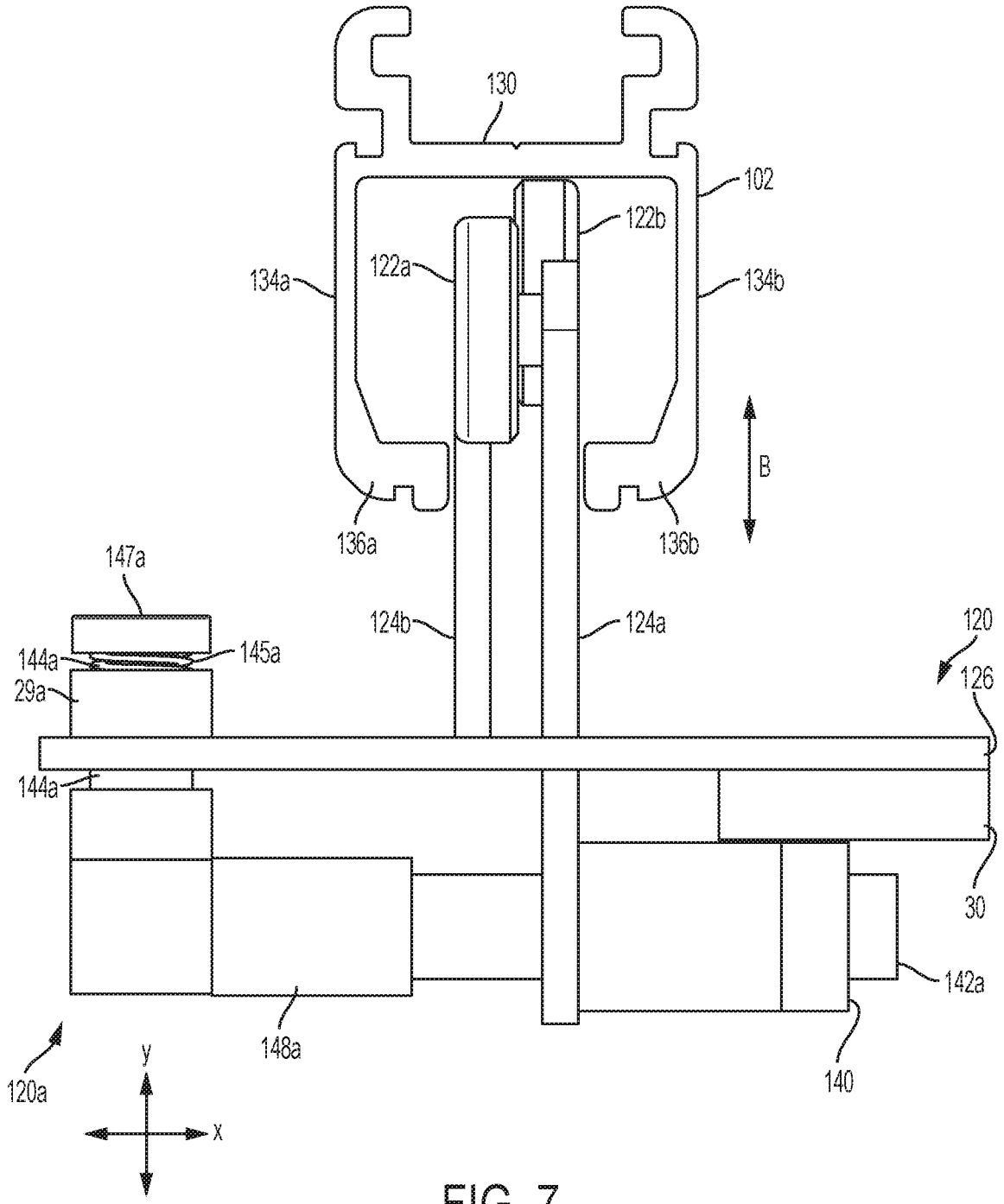
FIG. 7 schematically illustrates a front view of the carriage of FIG. 6 in a retracted configuration, according to one or more embodiments shown and described herein.
Figure 8:
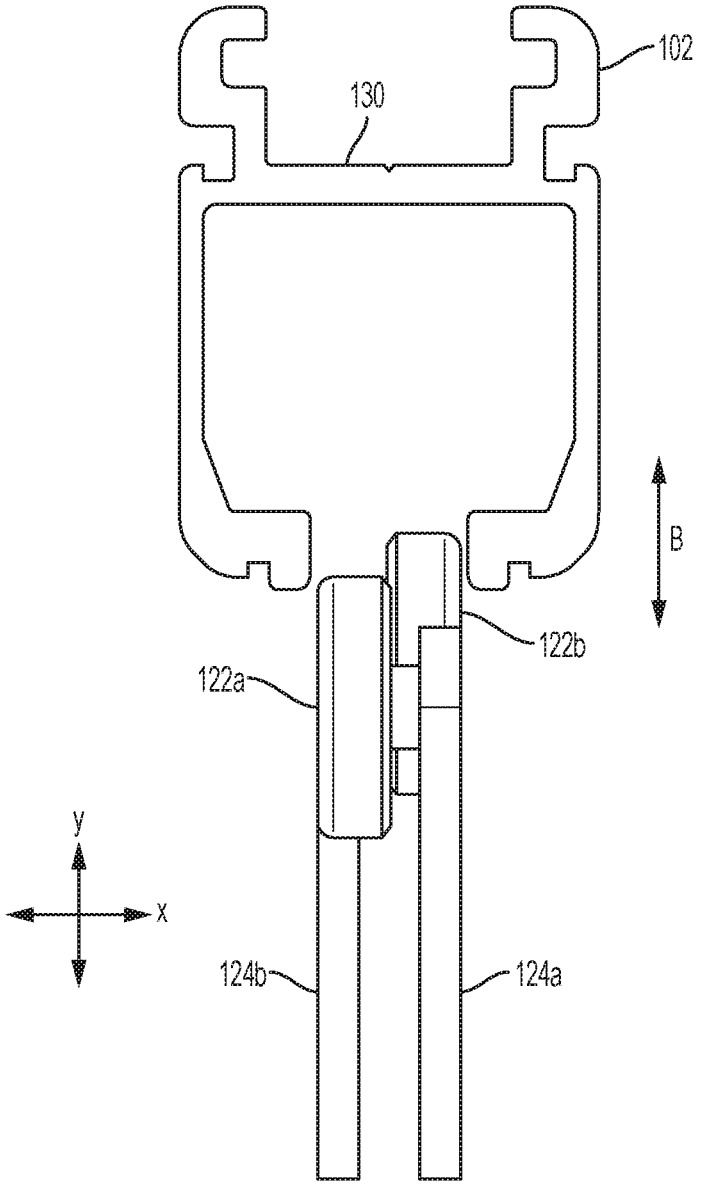
FIG. 8 schematically illustrates the carriage of FIG. 7 being guided through an opening defined by the overhead rail, according to one or more embodiments shown and described herein.

Once in the retracted position, as shown in FIG. 7, the carriage 106 may be moved in a vertical direction, as indicated by arrow B in FIG. 7, and removed from the overhead rail 102, as shown in FIG. 8.

Conversely, to attach the lift unit 104 to the overhead rail 102, the wheel assemblies of the carriage 106, while in the retracted position, as shown in FIG. 8, are extended through the opening of the overhead rail 102 between the first support flange 136*a* and the second support flange 136*b*. Next, the wheel assembly including the support wheel 122*a* and the support arm 124*a* are shifted from the retracted position to an expanded position relative to the wheel assembly including the support wheel 122*b* and the support arm 124*b*, as shown in FIG. 6. In various embodiments, the wheel assembly may be shifted by the actuator in response to a user input. Alternatively, the wheel assembly may be shifted manually by a user. When the wheel assembly is shifted from the retracted position to the expanded position, a lateral distance from the outer surface of the wheel assembly including the support wheel 122*b* and the support arm 124*b* to an outer surface of the wheel assembly including the support wheel 122*a* and the support arm 124*a* is increased as compared to the lateral distance when the wheel assembly is in the retracted position.

When the wheel assembly has been shifted into the expanded position, the user may release the lift unit 104 and weight of the lift unit 104 may be supported by the first support flange 136*a* and the second support flange 136*b* of the overhead rail 102, as shown in FIG. 3. In particular, when the user releases the lift unit 104, the carriage support plate 126 may shift downward relative to the support wheel 122*a* and the support arm 124*a*, allowing the support arm 124*a* to move vertically through the aperture in the carriage support plate 126 and bring the bearing member 138*a* into alignment with the locking mechanism 30.

It should now be understood that various embodiments described herein enable a lift unit 104 to be removeably attached to an overhead rail 102, such that the lift unit 104 may be used with various overhead rails 102. In other words, the lift unit 104 may be transported and coupled to any one of a number of overhead rails, which may reduce the number of lift units that a facility needs to purchase. Various embodiments may further enable lift units 104 to be decoupled from the overhead rail for servicing or the like. In addition, various embodiments may enable the lift unit 104 to be locked into place when supporting a load, such as a subject, thereby preventing the lift unit 104 from being inadvertently removed from the overhead rails 102 while in use.

Embodiments can be described with reference to the following numbered clauses, with preferred features laid out in the dependent clauses:

1. A lift unit comprising a carriage; a first wheel assembly comprising a first wheel coupled to the carriage through a first support arm; a second wheel assembly comprising a second wheel coupled to the carriage through a second support arm; and a guide assembly comprising a bearing member and a guide member along which the bearing member is slidable, the guide assembly coupled to the second wheel assembly, wherein the guide assembly is configured to shift the second wheel assembly in a lateral direction relative to the first wheel assembly between an expanded position and a retracted position.

2. The overhead lift unit of clause 1, wherein the first wheel assembly is fixed relative to the carriage.

3. The overhead lift unit of either clause 1 or clause 2, wherein the first wheel assembly is staggered with the second wheel assembly along a longitudinal direction and the retracted position is characterized by at least a portion of the first wheel assembly and the second wheel assembly being aligned in the lateral direction.

4. The overhead lift unit of any preceding clause, further comprising a locking mechanism configured to lock the second wheel assembly in the expanded position.

5. The overhead lift unit of clause 4, wherein the first wheel assembly and the second wheel assembly are configured to support the overhead lift unit within an overhead rail, and the locking mechanism is actuated when the first wheel assembly and the second wheel assembly are supporting at least a weight of the overhead lift unit within the overhead rail.

6. The overhead lift unit of any preceding clause, further comprising a controller communicatively coupled to the actuator, wherein the controller executes logic to cause the actuator to shift the second wheel assembly between the expanded position and the retracted position.

7. The overhead lift unit of clause 6, further comprising a user input device communicatively coupled to the controller, wherein the controller causes the actuator to shift the second wheel assembly between the expanded position and the retracted position based on an input received from the user input device.

8. A lift system comprising an overhead rail defining a carriage support channel comprising a first support flange and a second support flange, the first support flange separated from the second support flange to define an opening in the overhead rail; and an overhead lift unit. The overhead lift unit comprises a carriage; a first wheel assembly configured to extend through the opening of the overhead rail and to ride along the carriage support channel, the first wheel assembly comprising a first wheel coupled to the carriage through a first support arm; a second wheel assembly configured to extend through the opening of the overhead rail and to ride along the carriage support channel, the second wheel assembly comprising a second wheel coupled to the carriage through a second support arm; and an actuator coupled to the second wheel assembly, wherein the actuator is configured to shift the second wheel assembly in a lateral direction relative to the first wheel assembly between an expanded position in which the first wheel assembly and the second wheel assembly are coupled with the overhead rail, and a retracted position in which the first wheel assembly and the second wheel assembly are configured to pass through the opening in the overhead rail.

9. The lift system of clause 8, wherein the first wheel assembly is configured to ride along the first support flange and the second wheel assembly is configured to ride along the second support flange when the one of the first wheel assembly and the second wheel assembly are within the overhead rail and in the expanded position.

10. The lift system of clause 8 or clause 9, wherein the first wheel assembly comprises a first outer surface and the second wheel assembly comprises a second outer surface, wherein the retracted position is characterized by the first outer surface of the first wheel assembly and the second outer surface of the second wheel assembly being separated by a distance less than a width of the opening between the first support flange and the second support flange.

11. The lift system of any of clauses 8-10, wherein the first wheel assembly is fixed relative to the carriage.

12. The lift system of any of clauses 8-11, wherein the first wheel assembly of the carriage is staggered with the second wheel assembly along a longitudinal direction and the retracted position is characterized by at least a portion of the first wheel assembly and the second wheel assembly being aligned in the lateral direction.

13. The lift system of any of clauses 8-12, wherein the overhead lift unit further comprises a locking mechanism configured to lock the second wheel assembly in the expanded position.

14. The lift system of clause 13, wherein the first wheel assembly is configured to ride along the first support flange and the second wheel assembly is configured to ride along the second support flange when the one of the first wheel assembly and the second wheel assembly are within the overhead rail and in the expanded position; and the locking mechanism locks the second wheel assembly in the expanded position when the first wheel assembly and the second wheel assembly are supporting a weight of at least the overhead lift unit on the first support flange and the second support flange of the overhead rail.

15. The lift system of any of clauses 8-14, further comprising a controller communicatively coupled to the actuator of the overhead lift unit, wherein the controller executes logic to cause the actuator to shift the second wheel assembly between the expanded position and the retracted position.

16. The lift system of clause 15, further comprising a user input device communicatively coupled to the controller, wherein the controller causes the actuator of the overhead lift unit to shift the second wheel assembly between the expanded position and the retracted position based on an input received from the user input device.

17. A method of transporting an overhead lift unit to and from an overhead rail, the method comprising one of attaching the overhead lift unit to the overhead rail and detaching the overhead lift unit from the overhead rail wherein the overhead rail defines a carriage support channel comprising a first support flange and a second support flange, the first support flange separated from the second support flange to define an opening in the overhead rail. The overhead lift unit comprises a carriage comprising: a first wheel assembly comprising a first wheel coupled to the carriage through a first support arm; a second wheel assembly comprising a second wheel coupled to the carriage through a second support arm; and an actuator coupled to the second wheel assembly. Attaching the overhead lift unit to the overhead rail comprises extending the first wheel assembly and the second wheel assembly through the opening of the overhead rail; shifting the second wheel assembly from a retracted position to an expanded position with the actuator, wherein a lateral distance from an outer surface of the first wheel assembly to an outer surface of the second wheel assembly is increased; and supporting a weight of the overhead lift unit on the carriage support channel with the first wheel of the first wheel assembly and the second wheel of the second wheel assembly. Detaching the overhead lift unit from the overhead rail comprises shifting the second wheel assembly from the expanded position to the retracted position, wherein the lateral distance from the outer surface of the first wheel assembly to the outer surface of the second wheel assembly is decreased; and lowering the overhead lift unit from the overhead rail through the opening.

18. The method of clause 17, wherein the overhead lift unit further comprises a locking mechanism configured to lock the second wheel assembly in the expanded position, and supporting the weight of the overhead lift unit within the carriage support channel activates the locking mechanism.

19. The method of clause 18, wherein detaching the overhead lift unit from the overhead rail comprises relieving the weight of the overhead lift unit from the first wheel of the first wheel assembly and the second wheel of the second wheel assembly, wherein relieving the weight of the overhead lift unit deactivates the locking mechanism.

20. The method of any of clauses 17-19, wherein the first wheel assembly is staggered with the second wheel assembly along a longitudinal direction and the retracted position is characterized by at least a portion of the first wheel assembly and the second wheel assembly being aligned in a lateral direction.

It is noted that the terms "substantially" and "about" may be utilized herein to represent the inherent degree of uncertainty that may be attributed to any quantitative comparison, value, measurement, or other representation. These terms are also utilized herein to represent the degree by which a quantitative representation may vary from a stated reference without resulting in a change in the basic function of the subject matter at issue.

While particular embodiments have been illustrated and described herein, it should be understood that various other changes and modifications may be made without departing from the spirit and scope of the claimed subject matter. Moreover, although various aspects of the claimed subject matter have been described herein, such aspects need not be utilized in combination. It is therefore intended that the appended claims cover all such changes and modifications that are within the scope of the claimed subject matter.

What is claimed is:

1. An overhead lift unit comprising:

a carriage;

a first wheel assembly comprising a first wheel coupled to the carriage with a first support arm;

a second wheel assembly comprising a second wheel coupled to the carriage with a second support arm, wherein the first wheel assembly is staggered with the second wheel assembly along a longitudinal direction; and a guide assembly comprising a bearing member and a guide member along which the bearing member is slidable, the guide assembly coupled to the second wheel assembly, wherein the guide assembly is configured to shift the second wheel assembly in a lateral direction relative to the first wheel assembly between an expanded position and a retracted position.

2. The overhead lift unit of claim 1, wherein the first wheel assembly is fixed relative to the carriage.

3. The overhead lift unit of claim 1, wherein when in the retracted position, at least a portion of the first wheel assembly and the second wheel assembly are aligned in the lateral direction.

4. The overhead lift unit of claim 1, further comprising a locking mechanism configured to lock the second wheel assembly in the expanded position.

5. The overhead lift unit of claim 4, wherein the first wheel assembly and the second wheel assembly are configured to support the overhead lift unit within an overhead rail, and the locking mechanism is actuated when the first wheel assembly and the second wheel assembly are supporting at least a weight of the overhead lift unit within the overhead rail.

6. The overhead lift unit of claim 1, further comprising a controller communicatively coupled to the actuator, wherein the controller executes logic to cause the actuator to shift the second wheel assembly between the expanded position and the retracted position.

7. The overhead lift unit of claim 6, further comprising a user input device communicatively coupled to the controller, wherein the controller causes the actuator to shift the second wheel assembly between the expanded position and the retracted position based on an input received from the user input device.

8. A lift system comprising:

an overhead rail comprising a carriage support channel comprising a first support flange and a second support flange, the first support flange separated from the second support flange by an opening in the overhead rail; and an overhead lift unit comprising:

a carriage;

a first wheel assembly configured to extend through the opening of the overhead rail and to ride along the carriage support channel, the first wheel assembly comprising a first wheel coupled to the carriage with a first support arm;

a second wheel assembly configured to extend through the opening of the overhead rail and to ride along the carriage support channel, the second wheel assembly comprising a second wheel coupled to the carriage with a second support arm; and an actuator coupled to the second wheel assembly, wherein the actuator is configured to shift the second wheel assembly in a lateral direction relative to the first wheel assembly between an expanded position in which the first wheel assembly and the second wheel assembly are coupled with the overhead rail, and a retracted position in which the first wheel assembly and the second wheel assembly are configured to pass through the opening in the overhead rail.

9. The lift system of claim 8, wherein the first wheel assembly is configured to ride along the first support flange and the second wheel assembly is configured to ride along the second support flange when the one of the first wheel assembly and the second wheel assembly are within the overhead rail and the second wheel assembly is in the expanded position.

10. The lift system of claim 8, wherein the first wheel assembly comprises a first outer surface and the second wheel assembly comprises a second outer surface, wherein when in the retracted position, the first outer surface of the first wheel assembly and the second outer surface of the second wheel assembly are separated by a distance less than a width of the opening between the first support flange and the second support flange.

11. The lift system of claim 8, wherein the first wheel assembly is fixed relative to the carriage.

12. The lift system of claim 8, wherein the first wheel assembly of the carriage is staggered with the second wheel assembly along a longitudinal direction and the retracted position is characterized by at least a portion of the first wheel assembly and the second wheel assembly being aligned in the lateral direction.

13. The lift system of claim 8, wherein the overhead lift unit further comprises a locking mechanism configured to lock the second wheel assembly in the expanded position.

14. The lift system of claim 13, wherein:

wherein the first wheel assembly is configured to ride along the first support flange and the second wheel assembly is configured to ride along the second support flange when the one of the first wheel assembly and the second wheel assembly are within the overhead rail and in the expanded position; and the locking mechanism locks the second wheel assembly in the expanded position when the first wheel assembly and the second wheel assembly are supporting a weight of at least the overhead lift unit on the first support flange and the second support flange of the overhead rail.

15. The lift system of claim 8, further comprising a controller communicatively coupled to the actuator of the overhead lift unit, wherein the controller executes logic to cause the actuator to shift the second wheel assembly between the expanded position and the retracted position.

16. The lift system of claim 15, further comprising a user input device communicatively coupled to the controller, wherein the controller causes the actuator of the overhead lift unit to shift the second wheel assembly between the expanded position and the retracted position based on an input received from the user input device.

17. A method of transporting an overhead lift unit to and from an overhead rail, the method comprising one of attaching the overhead lift unit to the overhead rail and detaching the overhead lift unit from the overhead rail wherein:

the overhead rail defines a carriage support channel comprising a first support flange and a second support flange, the first support flange separated from the second support flange to define an opening in the overhead rail;

the overhead lift unit comprises a carriage comprising:

a first wheel assembly comprising a first wheel coupled to the carriage through a first support arm;

a second wheel assembly comprising a second wheel coupled to the carriage through a second support arm; and an actuator coupled to the second wheel assembly;

attaching the overhead lift unit to the overhead rail comprises:

extending the first wheel assembly and the second wheel assembly through the opening of the overhead rail;

shifting the second wheel assembly from a retracted position to an expanded position with the actuator, wherein a lateral distance from an outer surface of the first wheel assembly to an outer surface of the second wheel assembly is increased; and supporting a weight of the overhead lift unit on the carriage support channel with the first wheel of the first wheel assembly and the second wheel of the second wheel assembly; and detaching the overhead lift unit from the overhead rail comprises:

shifting the second wheel assembly from the expanded position to the retracted position, wherein the lateral distance from the outer surface of the first wheel assembly to the outer surface of the second wheel assembly is decreased; and lowering the overhead lift unit from the overhead rail through the opening.

18. The method of claim 17, wherein the overhead lift unit further comprises a locking mechanism configured to lock the second wheel assembly in the expanded position, and supporting the weight of the overhead lift unit within the carriage support channel activates the locking mechanism.

19. The method of claim 18, wherein detaching the overhead lift unit from the overhead rail comprises relieving the weight of the overhead lift unit from the first wheel of the first wheel assembly and the second wheel of the second wheel assembly, wherein relieving the weight of the overhead lift unit deactivates the locking mechanism.

20. The method of claim 17, wherein the first wheel assembly is staggered with the second wheel assembly along a longitudinal direction and the retracted position is characterized by at least a portion of the first wheel assembly and the second wheel assembly being aligned in a lateral direction.

* * * * *